US011377127B2

(12) United States Patent
Beha

(10) Patent No.: US 11,377,127 B2
(45) Date of Patent: Jul. 5, 2022

(54) STATION FOR A CABLE TRANSPORTATION SYSTEM, CABLE TRANSPORTATION SYSTEM COMPRISING SUCH STATION AND METHOD FOR OPERATING SUCH CABLE TRANSPORTATION SYSTEM

(71) Applicant: LEITNER S.P.A., Vipiteno (IT)

(72) Inventor: Rudolf Beha, Schönberg im Stubaital (AT)

(73) Assignee: LEITNER S.P.A., Vipiteno (IT)

( * ) Notice: Subject to any disclaimer, the term of this patent is extended or adjusted under 35 U.S.C. 154(b) by 369 days.

(21) Appl. No.: 16/499,731

(22) PCT Filed: Apr. 3, 2018

(86) PCT No.: PCT/IB2018/052288

§ 371 (c)(1),
(2) Date: Sep. 30, 2019

(87) PCT Pub. No.: WO2018/185653

PCT Pub. Date: Oct. 11, 2018

(65) Prior Publication Data

US 2021/0101626 A1 Apr. 8, 2021

(30) Foreign Application Priority Data

Apr. 3, 2017 (IT) ..... 102017000036544

(51) Int. Cl.
*B61B 1/02* (2006.01)
*B61B 12/02* (2006.01)

(52) U.S. Cl.
CPC ..... *B61B 1/02* (2013.01); *B61B 12/02* (2013.01)

(58) Field of Classification Search
CPC ..... B61B 1/02; B61B 12/02
See application file for complete search history.

(56) References Cited

U.S. PATENT DOCUMENTS 4,050,385 A * 9/1977 Gurr ..... B61B 11/00 104/173.2
4,246,848 A * 1/1981 Schneider ..... B61B 12/028 104/173.2

(Continued)

FOREIGN PATENT DOCUMENTS

CN 101654104 2/2010
EP 1849674 10/2007

(Continued)

OTHER PUBLICATIONS

Notification Concerning Submission, Obtention or Transmittal of Priority Document for International Application No. PCT/IB2018/052288 dated May 31, 2018.

(Continued)

*Primary Examiner* — Robert J McCarry, Jr.
(74) *Attorney, Agent, or Firm* — Neal, Gerber & Eisenberg LLP

(57) ABSTRACT

A station for a cable transportation system comprising a plurality of transporting units supported and moved outside the station by at least one cable, the station comprising an inlet and an outlet for the transporting units; a guiding device for guiding the transporting units inside the station between the inlet and the outlet; wherein the guiding device comprises an inlet guide extending from the inlet to a diverging point, a plurality of intermediate guides extending along different paths between the diverging point and a converging point; and an outlet guide extending from the converging point to the outlet of the station; a control unit configured for alternately feeding at least a transporting unit along the intermediate guides and for temporary stopping the transporting unit at at least one stopping point along the intermediate guides for enabling the embarking and disembarking while the transporting unit is stopped.

9 Claims, 3 Drawing Sheets

(56) References Cited

U.S. PATENT DOCUMENTS

| | | | | |
|---|---|---|---|---|
| 4,641,585 | A * | 2/1987 | Tarassoff | B61B 12/022 104/173.2 |
| 4,712,486 | A * | 12/1987 | Tarassoff | B61B 12/022 104/173.1 |
| 4,794,864 | A * | 1/1989 | Feuz | B61B 12/022 104/168 |
| 5,873,310 | A * | 2/1999 | Creissels | B61B 12/022 104/173.2 |
| 6,427,601 | B2 * | 8/2002 | Albrich | B61B 7/00 104/173.1 |
| 8,960,096 | B2 * | 2/2015 | Veyrat | B61B 1/02 104/28 |
| 2021/0101626 | A1 * | 4/2021 | Beha | B61B 1/02 |

FOREIGN PATENT DOCUMENTS

| | | | | |
|---|---|---|---|---|
| EP | 2157004 | | 2/2010 | |
| FR | 2731196 | | 9/1996 | |
| FR | 2752803 | | 3/1998 | |
| FR | 2899191 | | 10/2007 | |
| FR | 2970929 | | 8/2012 | |
| WO | WO 96/29223 | | 9/1996 | |
| WO | WO-2008020021 | A1 * | 2/2008 | B61B 12/002 |
| WO | WO-2009016211 | A1 * | 2/2009 | B61B 12/04 |

OTHER PUBLICATIONS

International Search Report and Written Opinion for International Application No. PCT/IB2018/052288 dated Jul. 5, 2018.

PCT Demand for International Preliminary Examination and Reply to International Search Report and the associated Written Opinion for International Application No. PCT/IB2018/052288 dated Jan. 24, 2019.

Notification of Receipt of Demand by Competent International Preliminary Examining Authority (Form PCT/IPEA/402) for International Application No. PCT/IB2018/052288 dated Feb. 5, 2019.

Notification of Transmittal of the International Preliminary Report on Patentability (Form PCT/IPEA/416) for International Application No. International Application No. PCT/IB2018/052288 dated Mar. 11, 2019.

Chinese Office Action for Application No. 201880023453.2 dated Jun. 30, 2020 (15 pages).

* cited by examiner

STATION FOR A CABLE TRANSPORTATION SYSTEM, CABLE TRANSPORTATION SYSTEM COMPRISING SUCH STATION AND METHOD FOR OPERATING SUCH CABLE TRANSPORTATION SYSTEM

PRIORITY CLAIM

This application is a national stage application of PCT/IB2018/052288, filed on Apr. 3, 2018, which claims the benefit of and priority to Italian Patent Application No. 102017000036544, filed on Apr. 3, 2017, the entire contents of which are each incorporated by reference herein.

TECHNICAL FIELD

The present disclosure relates to a station for a cable transportation system.

In particular, the present disclosure relates to a station of a cable transportation system for the embarkation and disembarkation of passengers or material that are transported outside the station by transporting units, for example chairs or gondolas or the like, supported and/or hauled by at least one cable.

Even more in particular, the present disclosure relates to a station of a cable transportation system, which can be an upstream station, a downstream station or an intermediate station, inside which the transporting units temporarily stop their advance to enable a relatively safe embarkation and disembarkation.

BACKGROUND

As is known, a station of a cable transportation system comprises an inlet and an outlet for the transporting units arranged in succession one after the other. At the inlet and the outlet, respectively, the station is provided with devices for uncoupling and coupling the transporting units from/to the cable, which only supports/hauls the transporting units outside the station. This selective uncoupling of the transporting units from the cable inside the station has the purpose of allowing the slowing down of the transporting units passing through the station without however slowing down the remaining transporting units moving outside the station.

Within this type of stations, the provision of a guide system configured to support the transporting units when uncoupled from the cable and to guide them from the inlet to the outlet of the station is known. This guiding device is usually in the form of at least one rail located above the transporting unit, which extends, in plan view, from the inlet to the outlet of the station where the rail ends at a cable-coupling device. Beyond the coupling device, the transporting unit is coupled, for example clamped, to the cable and proceeds to the next station of the system.

The extension in plan of the guiding device inside the station as defined above can be divided into a succession of portions or sections. In particular, it is possible to identify:

- an inlet portion delimited upstream by the station entry point, where the cable uncoupling device is arranged, and along which the transporting unit is slowed down;
- an intermediate portion at which the disembarkation and embarkation take place; and
- an outlet portion delimited downstream by the station exit point, where the cable-coupling device is arranged, and along which the transporting unit is accelerated up to a speed such as to allow a secure coupling to the cable (i.e., without or with minimizing jerks).

The indicated terms "upstream" and "downstream" are related to the forward direction of the transporting unit in the station.

To maximize the hourly capacity of the system, it is today common practice in certain of the prior art to not stop the transporting units during the embarkation and disembarkation procedures. Therefore, along the intermediate guide portions, the transporting units advance at a constant relatively low speed.

Still further to maximize the hourly capacity of the system, the provision of a plurality of intermediate guide portions inside the station is known to provide a plurality of embarking and disembarking zones mutually arranged in a parallel structure.

According to these systems, the inlet guide portion ends downstream, at a diverging point of the guide itself beyond which at least two intermediate guide portions branch off along two different paths. As is known, a selector device, for example of the railroad switch type, is provided at the diverging point, which selector device is configured to alternately feed the units along one or the other of the two intermediate guide portions. Similarly, the outlet guide portion starts upstream at a converging point in which the two aforesaid intermediate embarking and disembarking portions converge.

European Patent No. EP2157004, French Patent No. FR2752803 and European Patent No. EP1849674 show stations such as foregoing described wherein inside the station there is a plurality of embarking and disembarking zones mutually arranged in a parallel structure along which the transporting units advance at a constant relatively low speed.

SUMMARY

The object of the present disclosure is to provide an alternative station for a cable transportation system in which passengers are embarked and disembarked relatively safely and relatively comfortably without however compromising the hourly capacity of the respective cable transportation system.

According to the disclosure, the station comprises an inlet and an outlet for the transit of a plurality of transporting units, for example gondolas, chairs or the like, arranged in succession one after the other. Outside the station, the transporting units are supported and moved by at least one cable. Inside the station, the same transporting units are uncoupled from the cable and guided along a suitable guiding device, for example upper rails. To this end, at the inlet and the outlet, the station is thus provided with cable uncoupling and coupling devices. In the station of the present disclosure, the guiding device extends, in plan view, within the station between the inlet and the outlet and comprises an inlet guide extending from the inlet to a diverging point, a plurality of intermediate guides extending along different paths between the diverging point and a converging point, and an outlet guide extending from the converging point to the outlet of the station.

The station of the present disclosure further comprises a control unit, which can also be the control unit of the entire system, configured to alternately feed at least one transporting unit along the intermediate guides. In other words, all the transporting units travel in a line the inlet guide, and at the diverging point are alternately diverted, individually or in groups, towards one or the other intermediate guide.

In particular, according to the present disclosure, the control unit further temporary stops the transporting units at at least one stopping point along the intermediate guides configured to enable the embarking and disembarking while the transporting unit is stopped. In the event that the control unit alternately diverts a group or train of transport units along the intermediate guides, each gondola of the diverted group is stopped at its own stopping point, and when the embarking and disembarking is completed, the entire group starts off again at the same time towards the outlet guide. In this way, disembarking and embarking take place simultaneously for the entire group of transporting units, as is usually the case for the carriages of an underground train.

Although the transporting units are temporarily stopped, their motion outside the station is not slowed down because the transporting unit at the inlet is diverted by the control unit to the intermediate guide inside which there is always a free stopping point.

According to the above, the present disclosure thus enables a relatively safe embarkation and disembarkation while the transporting units are stopped, without compromising the hourly capacity of the system. It should thus be appreciated that embarking and disembarking while the gondolas are moving is considered disadvantageous especially in urban and tourist transport since in such environments passengers are accustomed to other avenues of urban transport where embarking and disembarking always take place when the vehicle is stationary. Furthermore, in urban applications the number of people with limited mobility is significantly higher than in winter sports applications. In general, considering "m" as the number of intermediate guides provided and "n" as the number of transporting units that make up the diverted group, without compromising the hourly capacity of the system and maintaining the distance of the in-line transporting units unchanged, the theoretical stop time is equal to $(m-1)*n$ times the space between the in-line gondolas.

According to one embodiment of the disclosure, the station comprises at least one footboard or embarking and/or disembarking platform at at least one portion of the intermediate guides. In particular, such a platform is provided with a plurality of platform doors at the stopping points where the transporting units stop. Such an embodiment thus increases the relative safety of the station both because the platform doors are configured to only open in the presence of a stationary transporting unit, thus avoiding the relative dangers of falling into the station pit.

According to one embodiment of the disclosure, the station comprises at least one time indication device configured to indicate the waiting time at each stopping point. This embodiment thus enables the filling of the gondolas to be organised systematically, with the waiting time indicated at each stopping point. The people waiting can thus relatively easily spread at multiple embarkation points according to the waiting time.

In certain embodiments, the guiding device of the present disclosure comprises at least one module with a first and a second intermediate guide configured to define an inner zone between the intermediate guides, and two outer zones outside the intermediate guides with respect to the inner zone. Starting from this configuration of the guides, the present disclosure can be viewed according to different variants in which each variant is aimed at optimizing the embarkation/disembarkation procedures or at relatively simplifying the layout of the station.

According to one embodiment of the disclosure, the station comprises a common inner embarking and disembarking platform at the inner zone and a service platform for all transporting units. The term "embarking" is intended to mean that the platform is provided with a plurality of devices suitable for the transit of passengers who must embark on the transporting units, whereas the term "disembarking" is intended to mean that the platform is provided with a plurality of devices suitable for the transit of passengers who have come out of the transporting units and must leave the station. When only an "embarking" or a "disembarking" platform is indicated, this will therefore refer to a platform where passenger transit is provided and enabled only in a specific direction. In the example above, the common inner platform is to be understood as both an embarking and disembarking platform for all the transporting units diverted to the intermediate guides. This embodiment thus relatively simplifies the layout of the station by providing a single central platform.

An alternative embodiment of the disclosure provides two outer embarking and disembarking platforms respectively housed in the outer zones of each intermediate guide. According to this embodiment, the embarkation and disembarkation on/from the transporting units diverted to an intermediate guide occurs exclusively via the respective outer platform. In other words, not all the transporting units passing through the station can be accessed from an outer platform, only those that will be diverted along the intermediate guide facing the corresponding platform. According to this embodiment, the distribution of the passengers is organised in a systematic way, thus avoiding a common concentration zone.

An alternative embodiment of the disclosure provides an inner embarking and disembarking platform at the inner zone and an outer embarking and disembarking platform at an outer zone. According to this embodiment, the transporting units can be simplified by installing doors only on one side of the transporting units (i.e., the side facing the outer platform).

An alternative embodiment of the disclosure provides an outer platform at each outer zone and an inner platform at the inner zone. According to this embodiment, the inner platform is configured to only be an embarkation or a disembarkation platform, while the remaining outer platforms are configured to only be complementary disembarkation or embarkation platforms. This embodiment enables a systematic organization, thus avoiding the creation of two opposing flows of passengers moving on the same platform.

Of course, the present disclosure also extends to the whole cable transportation system comprising the transporting units, the cable and a plurality of stations, at least one of which is a station as previously described.

Additional features are described in, and will be apparent from the following Detailed Description and the figures.

BRIEF DESCRIPTION OF THE DRAWINGS

Further features and technical scope of the present disclosure will be apparent from the following description of a non-limiting embodiment thereof, with reference to the figures of the accompanying drawings, wherein.

DETAILED DESCRIPTION

The present disclosure relates to a station for a cable transportation system, a cable transportation system equipped with such a station, and the method for operating the system as regards the management of the movement of the transporting units inside the station.

Figure 1:
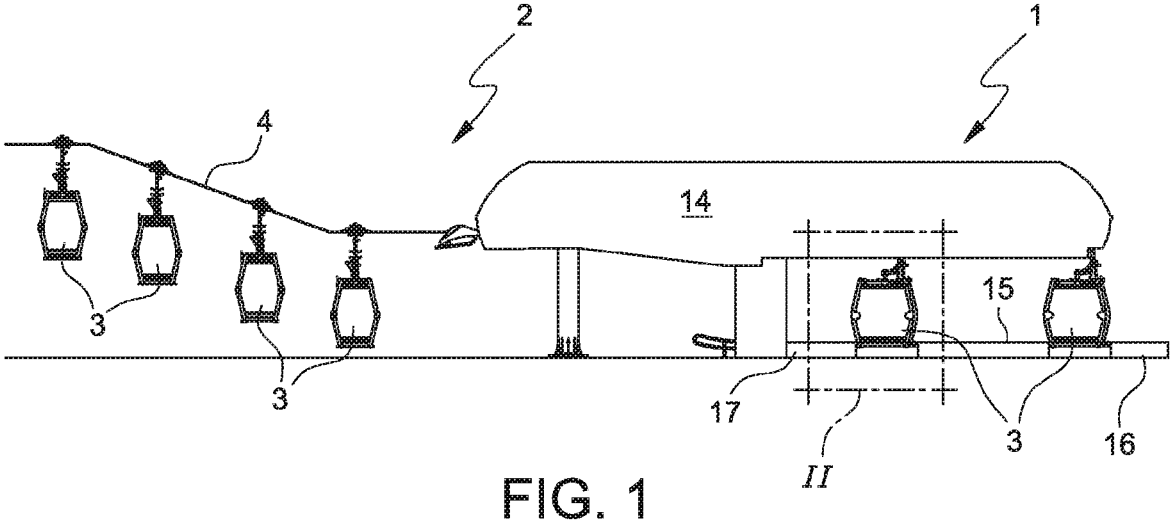
FIG. 1 is a schematic, side elevation view of a portion of a cable system equipped with an example of a station according to the present disclosure.

FIG. 1 shows a schematic, side elevation view of a portion of a cable system 2 provided with a station 1 according to the present disclosure. In particular, FIG. 1 shows a plurality of transporting units 3, in succession one after the other, which are supported and moved outside the station 1 by a carrying/hauling cable 4. As already evident from the schematic view in FIG. 1, inside the station 1 of the present disclosure the transporting units 3 are alternately diverted along two different paths such that at least two transporting units are at at least one embarking and disembarking platform. According to the example in FIG. 1, the station has three platforms 15, 16 and 17, respectively, both between the two transporting units 3 and outside the latter. The reference numeral 14 in FIG. 1 schematizes a control unit configured to control the movement of the transporting units 3 inside the station 1. However, this control unit 14 may also be used to control the entire system, therefore without providing one control unit for each station.

Figure 2:
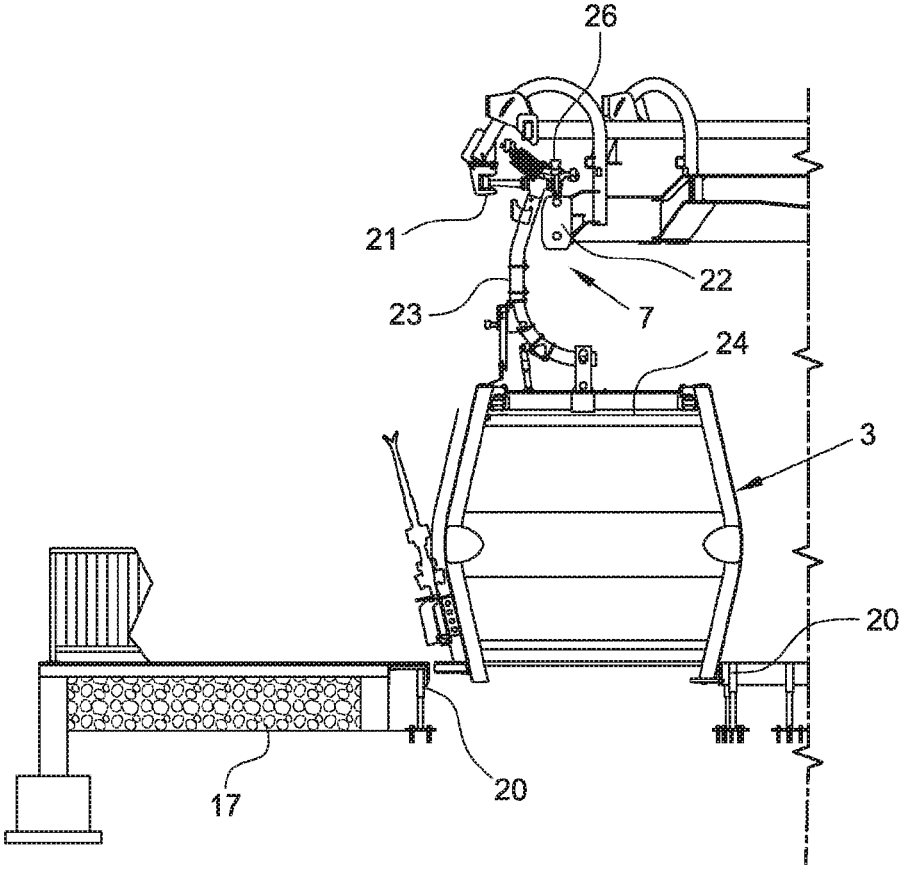
FIG. 2 is an enlarged view of the detail indicated as II in FIG. 1 showing an embodiment of a guiding device inside the station.

FIG. 2 shows an enlarged view of the detail indicated as II in FIG. 1. In particular, FIG. 2 shows how the transporting units are guided inside the station 1 where they are no longer coupled to the cable 4.

According to the example of FIG. 2, the station 1 comprises a guiding device 7 in the form of a pair of rails 21, 22 which support respective roller portions of a suspension arm 23 connected to the roof 24 of the transporting unit 3. The advancing, acceleration and deceleration of the transporting units along these tracks 21, 22 are imposed by a plurality of motorized wheels (not shown and, in certain embodiments, made of rubber), which act, in certain embodiments, against a corresponding knurled portion 26 at the top of the suspension arm 23. At the bottom, the represented transporting unit 3 is contained by side walls 20 optionally integrated into the disembarkation and embarkation platforms 17.

FIGS. 3 to 6 show schematic views of alternative embodiments of stations according to the present disclosure. In particular, these embodiments differ in the arrangement of the embarking and disembarking platforms 15, 16, 17 with respect to the guiding device 7. However, all these embodiments, which show repeatable modules even within the same station, enable the movement of the transporting units 3 in the station 1 to be controlled as provided in the present disclosure. In this respect, before describing in detail the differences in the embodiments of FIGS. 3 to 6, attention will be given to the common characteristics that contribute to the implementation of the disclosure.

In particular, in all the embodiments of FIGS. 3 to 6 the guiding device 7 comprises a plurality of guides arranged in succession (and shown in plan view) between the inlet 5 and the outlet 6 of the station. At such inlet 5 and outlet 6 points of the station 1, the reference numerals 25 and 27 schematize a device for respectively uncoupling and coupling the cable 4. The arrows I and O indicate the forward direction of the transporting units 3 entering and exiting the station 1.

In particular, the guiding device 7 comprises an inlet guide 8 extending from the inlet 5 to a diverging point 9, two intermediate guides 10, 11 extending along different paths between the diverging point 9 and a converging point 12, and an outlet guide 13 extending from the converging point 12 to the outlet 6 of the station 1. Selector devices are provided at the diverging 9 and converging 12 points, which are configured so as to ensure a secure passage of the transporting units 3 at such switches. In the examples of FIGS. 3 to 6, the station 1 is configured to be an upstream station or a downstream station, but for the purposes of the present disclosure the station 1 may also be an intermediate station.

In view of the presence of two intermediate guides 10 and 11, the control unit 14 feeds in an alternating, cyclic manner a transporting unit 3 along the first intermediate guide 10 and the subsequent transporting unit 3 along the first intermediate guide 11 by controlling the operation of the selector 9. According to the examples shown, the control unit 14 activates the selector 9 when a group or train of units 3, for instance four as shown, is reached, not upon the passage of a single transporting unit 3. According to the disclosure, the control unit 14 also commands a temporary stop of the transporting units 3 at corresponding stopping points along the intermediate guides 10, 11 configured to enable the embarking and disembarking while the transporting units 3 are stopped. According to this example (i.e., with groups of four selectively diverted units 3), the control of the station can be schematized as follows.

Initially, all the stopping points provided along both the intermediate guides 10 and 11 are occupied with the respective transport units stationary to enable embarking and disembarking. In this condition, a transporting unit enters the station while a first group of transporting units 3 is set in motion along the first intermediate guide 10. The first unit of this first group exiting the station occupies the gap left along the cable 4 by the vehicle entering the station 1. This entering unit is diverted towards the first intermediate guide 10, which is being emptied, until it reaches the stopping position downstream of the guide. Similarly, the next unit entering the station 1 will be diverted to the first intermediate guide 10 until it reaches the free stopping position downstream of the guide. As indicated above, the "gaps" left along the cable 4 by the units entering the station are filled by the units exiting the same.

This procedure continues until the complete filling of the stopping positions provided along the first intermediate guide 10. At this point, the next entering transporting unit is no longer diverted towards the first intermediate guide 10, but rather towards the second one 11 where the present train of units is operated so that it leaves the station 1. Similarly as described above, the second intermediate guide 11 is also gradually emptied and filled again along the stopping positions. In this condition, the starting point is reached again and the cycle can be repeated.

As previously mentioned, the operation of the station as described above is applicable to all the embodiments shown in FIGS. 3 to 6, which differ from each other in the relative positioning of the platforms with respect to the stopping positions of the units 3 along the intermediate guides 10 11.

Figure 3:
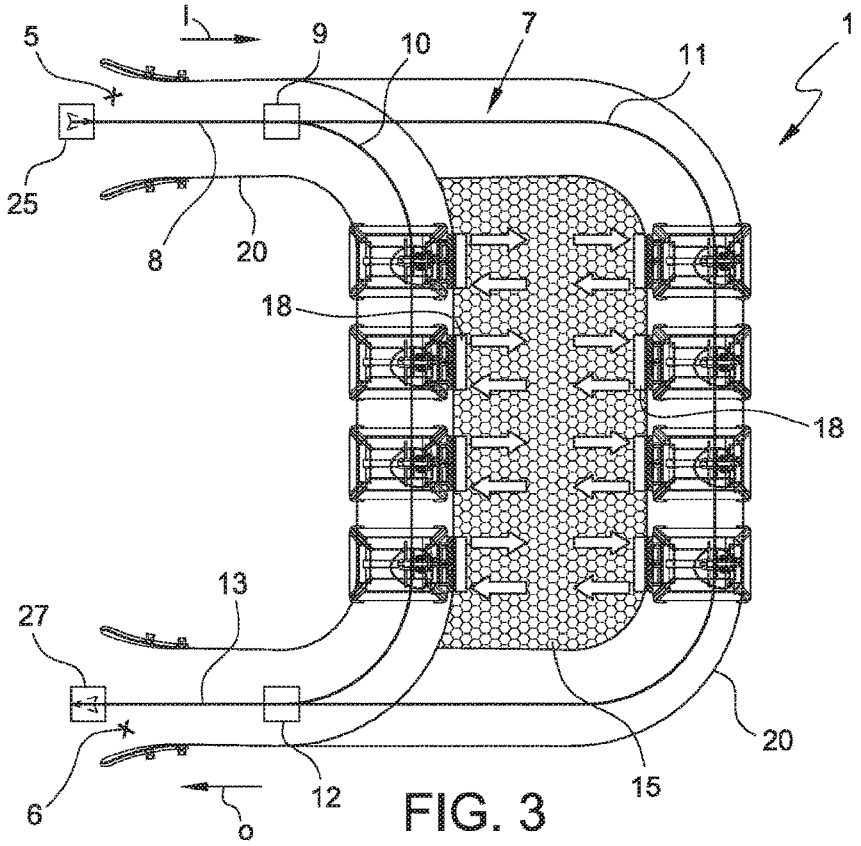
FIGS. 3, 4, 5, and 6 show schematic views of alternative embodiments of stations according to the present disclosure.

According to the example in FIG. 3, the station 1 comprises a common inner embarking and disembarking platform 15 arranged in the inner zone between the first 10 and the second 11 intermediate guide. According to this example, therefore, the platform 15 serves as an embarkation and disembarkation platform for all the transporting units 3 passing through the station.

Figure 4:
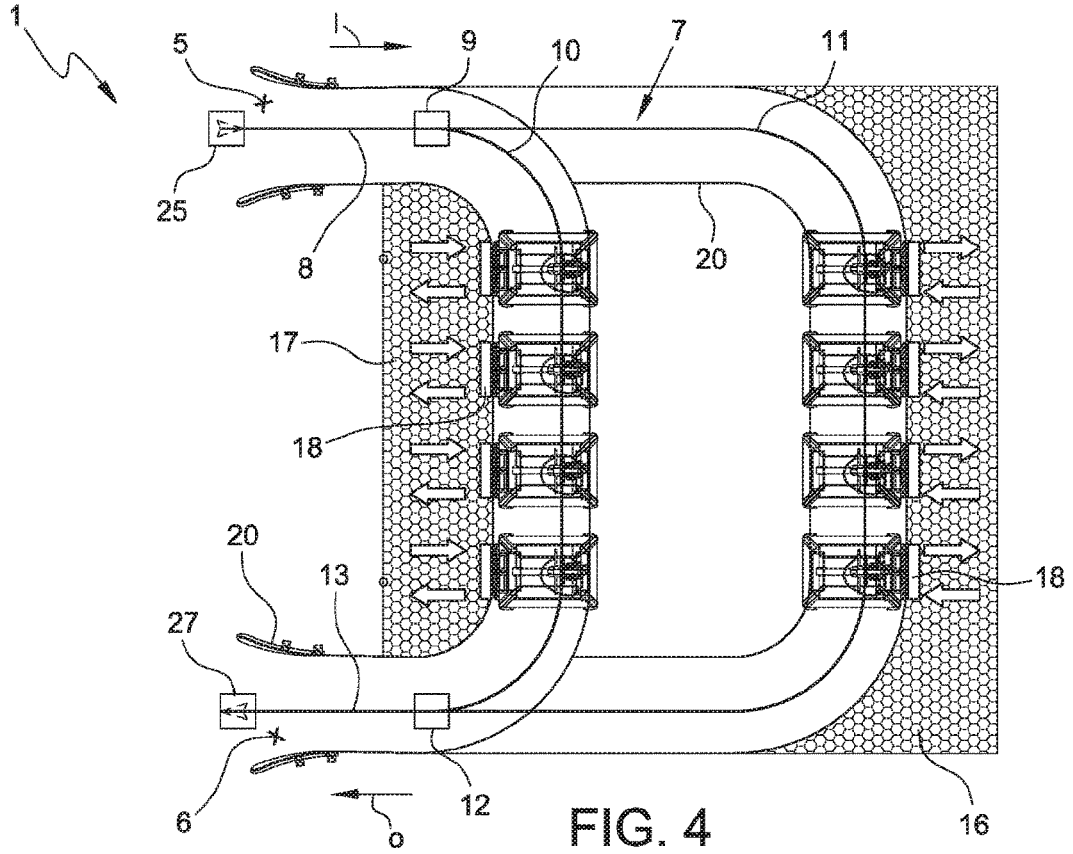

According to the example in FIG. 4, the station 1 comprises an outer embarkation and disembarkation platform 16, 17. According to this example, therefore, the platform 16 serves as an embarkation and disembarkation platform for all the transporting units 3 fed along the second intermediate guide 11, whereas the platform 17 serves as an embarkation and disembarkation platform for all the transporting units 3 fed along the first intermediate guide 10.

Figure 5:
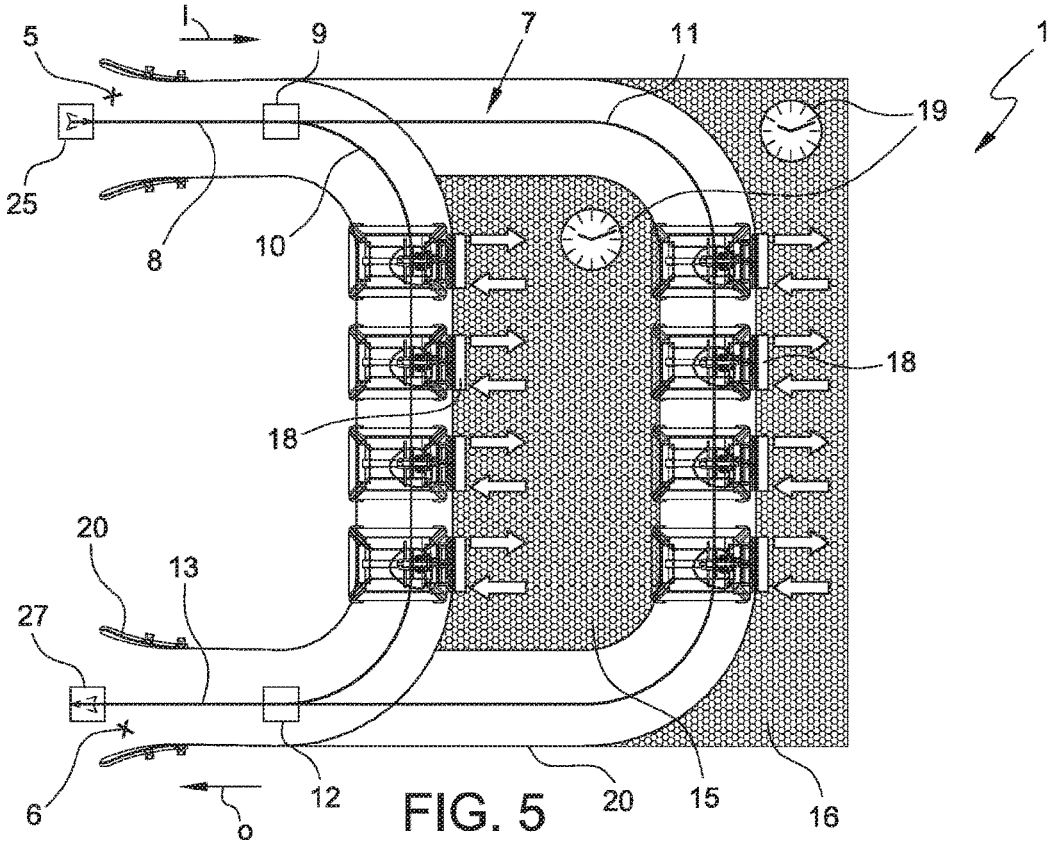

According to the example in FIG. 5, the station 1 comprises an inner embarking and disembarking platform 15 housed in the inner zone between the first 10 and the second 11 intermediate guide, and an outer embarking and disembarking platform 16, 17 at an outer zone of one of the intermediate guides 10, 11. The example shows the outer platform 16 coupled to the second intermediate guide 11, but alternatively the platform 17 coupled to the first intermediate guide 10 may be present.

Figure 6:
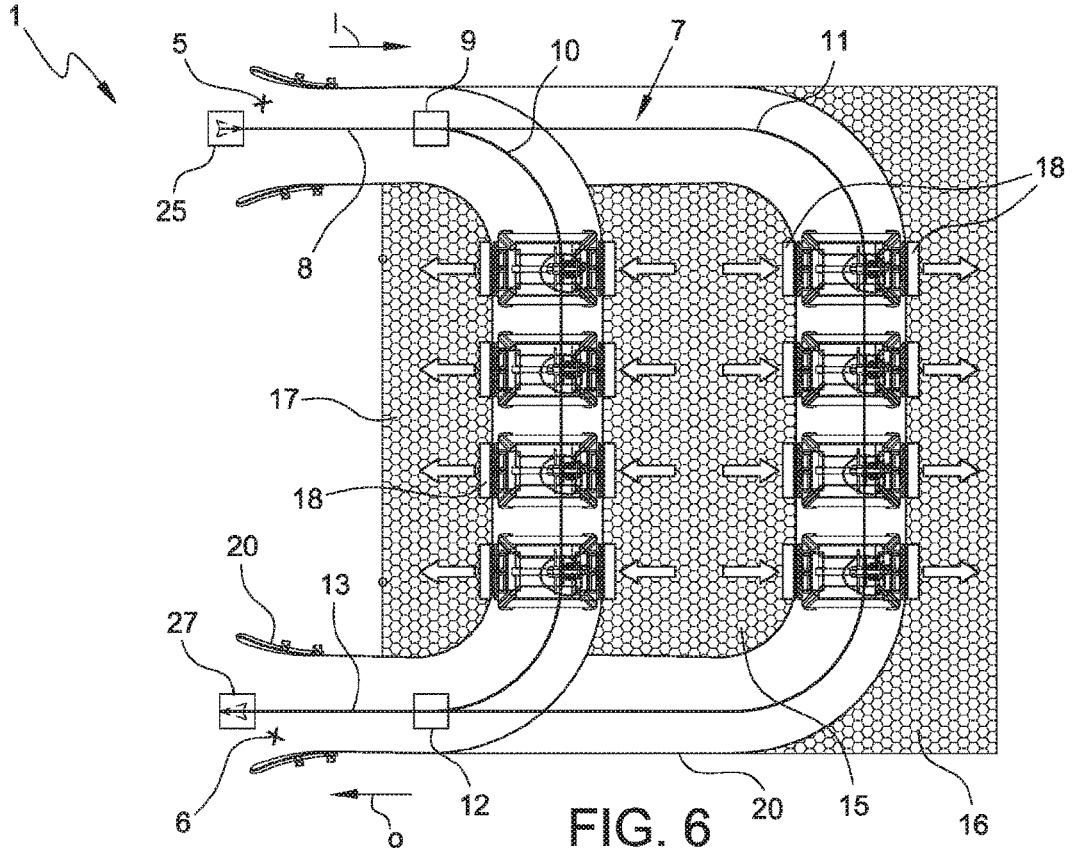

According to the example in FIG. 6, the station 1 comprises an outer embarking (or disembarking) platform 16, 17 at each outer zone of the intermediate guides 10, 11, and an inner embarking (or disembarking) platform 15 at the inner zone between the first 10 and the second 11 intermediate guide.

In FIGS. 3 to 6, the platforms 15, 16, 17 comprise a plurality of platform doors 18 at the stopping points where the units 3 stop along the intermediate guides 10, 11. FIG. 5 schematically shows a time indication device 19 configured to indicate the waiting time at each stopping point along the intermediate guides 10, 11. These time indication devices 19 may of course also be present in the remaining embodiments of FIGS. 3, 4 and 6 as well as in other embodiments of the disclosure described herein but not shown in the Figures.

Lastly, it is clear that modifications and variations may be made to the disclosure described herein without departing from the scope of the appended claims. As such, the present disclosure also covers embodiments not described in the detailed description and equivalent embodiments that fall within scope of the appended claims. Accordingly, various changes and modifications to the presently disclosed embodiments will be apparent to those skilled in the art.

The invention claimed is:

1. A cable transportation system station comprising:
an inlet;
an outlet;
a guiding device configured to guide a plurality of transporting units inside the station between the inlet and the outlet, the guiding device comprising:
an inlet guide extending from the inlet to a diverging point,
a plurality of intermediate guides extending along different paths between the diverging point and a converging point, and
an outlet guide extending from the converging point to the outlet; and
a control unit configured to:
alternately feed a group of at least two of the transporting units along the intermediate guides, and
for each transportation unit, temporarily stop that transportation unit at one of a plurality of stopping points along the intermediate guides to enable embarking and disembarking while that transporting unit is stopped.

2. The cable transportation system station of claim 1, further comprising at least one of an embarking platform and a disembarking platform at at least a portion of the intermediate guides, the platforms each provided with a plurality of platform doors adjacent to the stopping points.

3. The cable transportation system station of claim 1, further comprising a time indication device configured to indicate a waiting time at each stopping point.

4. The cable transportation system station of claim 1, wherein the guiding device comprises a first intermediate guide and a second intermediate guide that define:
an inner zone between the first intermediate guide and the second intermediate guide, wherein the inner zone includes a common inner embarking and disembarking platform, and
two outer zones outside, with respect to the inner zone, the first intermediate guide and the second intermediate guide.

5. The cable transportation system station of claim 1, wherein the guiding device comprises a first intermediate guide and a second intermediate guide that define:
an inner zone between the first intermediate guide and the second intermediate guide, and
two outer zones outside, with respect to the inner zone, the first intermediate guide and the second intermediate guide, wherein each outer zone includes an outer embarking and disembarking platform.

6. The cable transportation system station of claim 1, wherein the guiding device comprises a first intermediate guide and a second intermediate guide that define:
an inner zone between the first intermediate guide and the second intermediate guide, wherein the inner zone includes an inner embarking and disembarking platform, and
two outer zones outside, with respect to the inner zone, the first intermediate guide and the second intermediate guide, wherein one of the outer zones includes an outer embarking and disembarking platform.

7. The cable transportation system station of claim 1, wherein the guiding device comprises a first intermediate guide and a second intermediate guide that define:
an inner zone between the first intermediate guide and the second intermediate guide, wherein the inner zone includes an inner platform, and
two outer zones outside, with respect to the inner zone, the first intermediate guide and the second intermediate guide, wherein each of the outer zones includes an outer platform.

8. A cable transportation system comprising:
a plurality of transporting units supportable by and movable by at least a cable; and
a station comprising:
an inlet;
an outlet;
a guiding device configured to guide the plurality of transporting units inside the station between the inlet and the outlet, the guiding device comprising:
an inlet guide extending from the inlet to a diverging point,
a plurality of intermediate guides extending along different paths between the diverging point and a converging point, and
an outlet guide extending from the converging point to the outlet; and
a control unit configured to:
alternately feed a group of at least two of the transporting units along the intermediate guides, and
for each transportation unit, temporarily stop that transportation unit at one of a plurality of stopping points along the intermediate guides to enable embarking and disembarking while that transporting unit is stopped.

9. A method for operating a cable transportation system, the method comprising:

guiding a plurality of transporting units, one after another, inside a station via an inlet guide extending from an inlet to a diverging point;

alternately feeding a group of at least two of the transporting units along a plurality of intermediate guides extending along different paths between the diverging point and a converging point;

for each transportation unit, temporarily stopping that transportation unit at one of a plurality of stopping points along the intermediate guides to enable embarking and disembarking while that transporting unit is stopped; and guiding the transporting units, one after the outer, outside the station via an outlet guide extending from the converging point to an outlet of the station.

* * * * *